US005108103A

United States Patent [19]

Rilling

[11] Patent Number: 5,108,103

[45] Date of Patent: Apr. 28, 1992

[54] WRIST RELEASE TRAINER

[75] Inventor: John F. Rilling, Roswell, Ga.

[73] Assignee: Golf Research Technology, Inc., Norcross, Ga.

[21] Appl. No.: 672,350

[22] Filed: Mar. 20, 1991

[51] Int. Cl.[5] ..... A63B 53/00

[52] U.S. Cl. ..... 273/183 B; 273/186 R

[58] Field of Search ..... 273/183 R, 183 B, 183 D, 273/183 DA, 186 R, 186 A, 186 RA

[56] References Cited

U.S. PATENT DOCUMENTS

| | | | |
|---|---|---|---|
| 3,861,688 | 1/1975 | Butler | 273/183 B |
| 3,918,721 | 11/1975 | Trask, Jr. | 273/186 A |
| 4,193,065 | 3/1980 | Bittner | 273/183 B X |
| 4,660,829 | 4/1987 | Whiteneir | 273/183 B X |
| 4,743,028 | 5/1988 | Harrison | 273/183 B |
| 4,967,596 | 11/1990 | Rilling | 273/186 A X |

*Primary Examiner*—William H. Grieb

*Attorney, Agent, or Firm*—Trexler, Bushnell, Giangiorgi & Blackstone, Ltd.

[57] ABSTRACT

The wrist release is a device for monitoring wrist movement during a golf swing, and for learning the proper wrist movement needed to lower golf scores. The wrist release comprises an electronic circuit having signaling means and a unique transducer. The transducer comprises a housing having a bore, with a movable element disposed therein. The movable element is connected to means for monitoring a golfer's wrist movement. When the golfer has cocked his wrists properly, the movable element activates the electronic circuit, causing the signaling means to issue a feedback signal to the golfer. If the golfer does not cock his wrists properly, the feedback signal will be early, or nonexistent. In other embodiments, the device can be used to monitor arm extension, wrist cupping, or knee bending during a golf swing.

13 Claims, 3 Drawing Sheets

WRIST RELEASE TRAINER

BACKGROUND AND SUMMARY OF THE INVENTION

This invention relates generally to a wrist release trainer that can assist a golfer in learning how to cock, and release his wrists properly during a golf swing. Most golfers do not know how to cock their wrists in a correct manner, let alone how long to keep their wrists cocked. For many reasons, improper cocking of the wrists, and an improper release of the wrist cock leads to errant golf shots, increased golf scores, and greater golfer frustration with the game.

Most golfers fail to realize how important a proper cocking of the wrists, a proper arm extension, and a proper wrist release is to lower golf scores. Most golfers experience problems with hooking or slicing their shots, thereby missing the fairway or the green, and increasing their score. Often, these problems are caused by improper wrist action. When a golfer cocks and releases his wrists too soon during his downswing, he forces the club shaft, and, conjunctively, the club head and the striking face, to rotate. Thus, instead of the striking face contacting the golf ball with the plane of the striking face normal to the desired trajectory direction of the golf ball, the striking face contacts with the plane of the striking face being skewed with respect to the desired direction of trajectory of the ball. Because of this skewed striking configuration, the golf ball's trajectory is directed to the left or right, and away from the desired spot on the green or the fairway, resulting in a sliced or hooked shot.

Further, improper wrist action results in decreased directivity control of the shot, and decreased distance. When a golfer releases his wrists from the cocked position too early, he loses the opportunity to maximize the power in his downswing, and the speed of the club head. This is due to the flexibility present in the shaft of the golf club.

For the golfer to maximize club head speed the power in his downswing, it is necessary that the golfer keep his wrists cocked, and release them at the appropriate moment so that he may receive the benefit of the energy built up and stored in the golf club shaft, due to the flexing of the shaft during the back and downswings. Using proper wrist action will add more energy to the striking face, and thereby, to the golf ball, when it strikes the golf ball. Also, proper wrist action will result in greater control over the direction of the golf ball's trajectory.

Given these considerations, it is desirable to have a device that can monitor effectively the wrist action of the golfer during his golf swing, so that a golfer can learn the proper method of wrist action. Specifically, a device is needed to monitor the duration of the wrist cock. Preferably, such a device would be less expensive than the currently used methods for learning proper wrist action. Also, the device would offer feedback to the golfer, indicating when he should maintain his wrists in the cocked position, and when he should release them during his downswing.

There are other impediments to a proper golf swing which may also be reduced by use of the device. Improper extension of the elbows, and "cupping" (rotation of the hand about the wrist during a golf swing) of the wrists are problems common to many golfers. The desirability of the device would be increased if the device could assist in solving these problems as well. Such a device, if used properly and consistently, has the potential to teach a golfer proper wrist action, and elbow extension, resulting in lower golf scores, and to increase player enjoyment of the game.

OBJECTS AND SUMMARY OF THE INVENTION

A general object of the present invention is to provide a wrist release trainer that can monitor the wrist action of the golfer during his golf swing.

Another object of the invention is to provide a device that a golfer can use to learn how to use proper wrist action during his golf swing.

A further object of the invention is to provide a device that will be less expensive to the golfer than many other, currently available, means for monitoring, and learning proper wrist action.

An additional object of the invention is to provide a device that can assist the golfer in learning proper wrist action so as to reduce the number of golf shots that are either hooked or sliced.

An object of the invention is to provide a device that can instruct a golfer how to maximize the power in his downswing by taking advantage of the energy built up in the golf club shaft as it s flexed during the golf swing.

Another object of the invention is to provide a device that will provide feedback to the golfer, instructing him when his wrists are cocked, and when to release his wrists.

A further object of the invention is to provide a device that a golfer can use to learn proper arm extension during a golf swing.

An additional object of the present invention is to provide a device that a golfer can use to learn not to cup his wrists during a golf swing.

The wrist release trainer, constructed according to the teachings of the present invention, is a unique device for monitoring a golfer's wrist action during his golf swing, and teaching a golfer how to properly cock, and release his wrists during his golf swing.

The wrist release trainer is disposed within a container, similar in size to a pager beeper, which is designed to be attached to the shaft of the golf club, just below the club grip, a wristband designed to be worn by the golfer on his wrist, and a line attaching the wristband to the wrist release trainer.

The wrist release trainer includes an electronic circuit having a uniquely designed transducer. The transducer comprises a housing having a bore wherein a retaining post, a spring, and a magnet assembly are disposed. A reed relay is located adjacent to the housing outside of the bore. The spring is attached at one end to the retaining post, and at the other end to the magnet assembly. The magnet assembly has a sleeve slidable in the housing bore and a magnet carried within the sleeve. A line is attached to the magnet assembly at an end, which is opposite from the spring.

The magnet of the magnet assembly acts upon the reed relay, which actuates an electronic circuit having signaling means. When the golfer cocks and releases his wrists, the magnet assembly moves, under the influence of forces applied by the line and the spring, to a position where a magnetic field generated by the magnet actuates the reed relay, closing the electronic circuit, and causing the signaling means to issue a feedback signal to the golfer. The signaling means continues to issue the feedback signal until the wrists are released, and the magnet translates away from the reed relay. Then, the electronic circuit is reset, and the wrist release is ready for the next swing.

Other embodiments of the invention comprises the same, above discussed, construction with modifications which enable monitoring of elbow flexure during a golf swing and/or wrist movement during a putting or chipping stroke.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which.

DETAILED DESCRIPTION OF A PREFERRED EMBODIMENT

Figure 1:
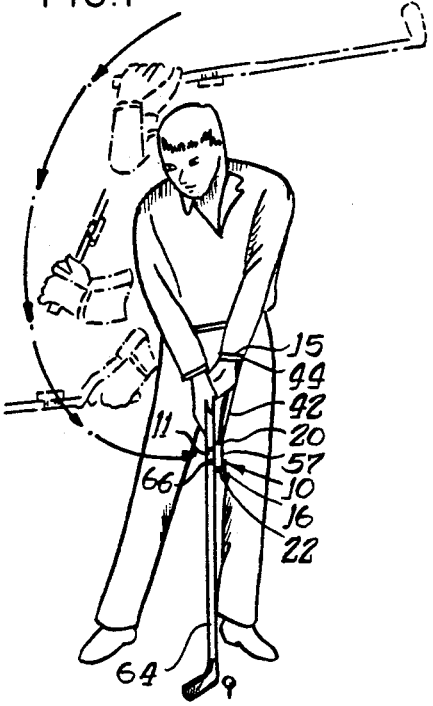
FIG. 1 is a sequential view of a golfer using the wrist release trainer to monitor his wrist action, and to learn a more appropriate wrist action.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
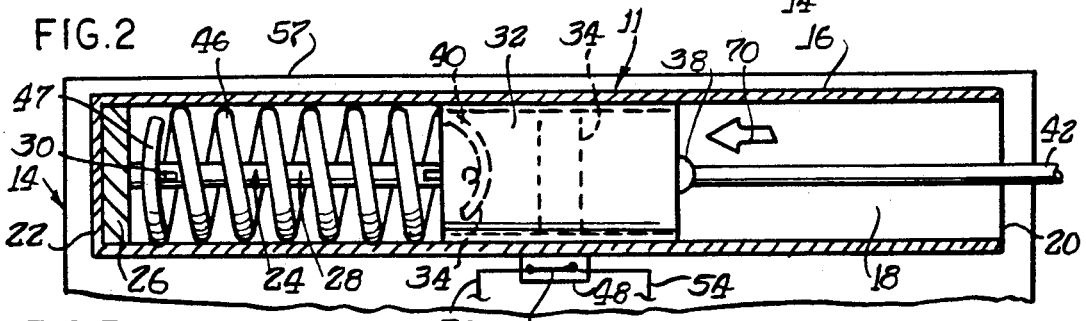
FIG. 2 is a sectional view of the transducer employed in the wrist release trainer, showing the particular disposition of the elements of the transducer, when the golfer has fully cocked his wrists, thus closing the electronic circuit, and activating the signaling means.

The wrist release trainer 10 comprises units 11 and 15 respectively mountable at opposite sides of a golfer's wrist or another point to be monitored. The unit 11 comprises an electronic circuit 1 2 having means responsive to the actuation of the transducer for providing the golfer with feedback representative of wrist movement, such as signaling means 13, and a uniquely designed transducer 14. Referring generally to FIG. 2, the particular construction of the transducer 14 is disclosed. The transducer 14 comprises a housing 16 having a bore 18. The bore 18 communicates the entire length of the housing 16, but the bore 18 leaves one end of the housing 16 intact. Therefore, the housing 16 has an open end 20 and a closed end 22.

A retaining post 24 having a base 26 and a leg 28 is disposed within the bore 18. The base 26 of the retaining post 24 is mounted within the bore 18 upon the interior surface of the closed end 22 of the housing 16. The base 26 expands to fill the entire cross section of the bore 18 at the closed end 22 of the housing 16 to lend support to the retaining post 24. The base 26 is joined perpendicularly to the leg 28, with the leg 28 extending along the axis of elongation of the bore 18. There is a catch 30 disposed on the leg 28, at a position in proximity to the base 26. The purpose of the catch 30 will become apparent herein.

A magnet assembly 32 having a sleeve 33 and a magnet 34, or other switch actuating element, also is disposed within the bore 18. The sleeve 33 has an aperture disposed through it, the aperture being of sufficient size to accept the magnet 34 and an end loop 37 of a spring 46 disposed within the bore 18 for a purpose described below. The magnet assembly 32 is capable of free translation within the bore 18. The magnet assembly 32 has a projection 38 disposed on one end thereof, and a transverse pin 40 disposed adjacent the other end thereof. The magnet assembly 32 is oriented within the bore 18 so that the projection 38 faces the open end 20.

The projection 38 is constructed so as to accept, and to hold firmly in place, one end of a connecting means of unit 13 mountable on a wrist, such as a line 42. The line 42 comprises a tension transmitting member. The line 42 extends from the projection 38 through the bore 18, and out of the housing 16 through the open end 20. At the other end, the line 42 is affixed to means mountable on a wrist, or a wristband 44. The wristband 44 is of sufficient size to accept a human wrist, and is of known construction.

The transverse pin 40 on the magnet assembly 32 is disposed so as to extend through the end loop 37 of the spring 46 as to connect the spring 46 to the sleeve 33. The catch 30 is designed to accept, and to hold firmly in place, an opposite end loop 47 of the spring 46. The spring 46 is disposed within the bore 18 about the retaining post 24 between the base 26, and the transverse pin-bearing end of the magnet assembly 32. The construction allows the magnet assembly 32 to translate freely within the bore 18 under the influence of forces exerted by the line 42, and the spring 46.

On the exterior of the housing 16 which is formed of plastic or other non-magnetic material, a magnetically operable switch, such as a reed relay 48, having a switch 50 is disposed. The reed relay 48 is of the type actuated by the presence of magnetic fields, and is of known construction. The reed relay 48 is mounted on the exterior surface of the housing 16 in a position so that the reed relay 48 can be actuated by the magnetic field generated by the magnet 34 disposed on the magnet assembly 32 within the bore 18. The position of the magnet 34 is dictated by the position of the magnet assembly 32, which translates under the influence of forces exerted by the spring 46 and the line 42.

The switch 50 of the reed relay 48 is connected to the remainder of the electronic circuit 12 by means of a first electrical connection 52, and a second electrical connection 54. With this construction, the translation of the magnet assembly 32 is able to actuate the reed relay 48, thereby closing the switch 50, allowing current to flow from the first electrical connection 52, across the switch 50, through the second electrical connection 54, into the remainder of the electronic circuit 12, to actuate the signaling means 13. The signaling means 13, such as an audio speaker, and the like, is a device that can provide a feedback signal to the golfer to let him know when his wrists are cocked, and when to uncock them during his golf swing.

Figure 4:
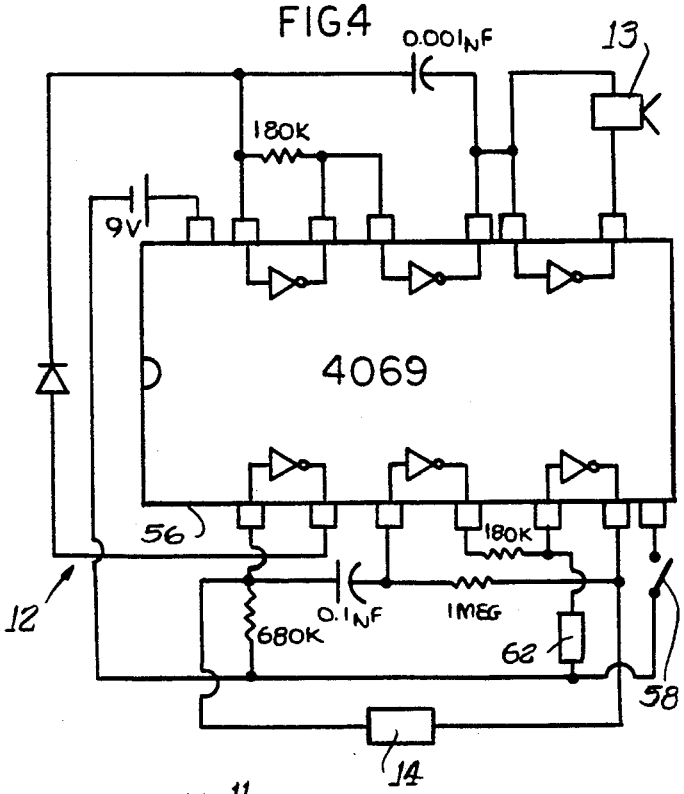
FIG. 4 is a schematic diagram of the electronic circuit employed by the wrist release trainer.

The electronic circuit 12, as shown in FIG. 4, is of a construction well known in the art. The electronic circuit 12 is comprised principally of a integrated circuit chip 56, similar to a 4069 chip, which is well known, bearing a plurality of inverting amplifiers, a transducer 14, constructed according to the teachings of this invention, signaling means 13, an on-off switch 58, a nine volt power source 60, such as an alkaline battery, and a reset switch 62. The on-off switch 58 energizes the integrated circuit chip 56 for operation. The transducer 14, when the switch 50 of the reed relay 48 is closed, allows current to flow through the electronic circuit 12 to actuate the signaling means 13. The transducer 14 allows the electronic circuit 12 to actuate the signaling means 13 until the switch 50 of the reed relay 48 is opened again. Once this occurs, the electronic circuit 12 must be reset to be prepared for the next golf swing. This is done by actuating the reset switch 62. With the reset switch 62 having been actuated, the wrist release trainer 10 is ready for another golf swing.

All of the elements, except the line 42 and the wristband 44, of the wrist release trainer 10 are disposed within a container 57 about the size of a pager beeper. The unit 11 of the wrist release trainer 10 is lightweight, and is constructed to be mounted directly onto a golf club shaft 64, at a location just below the club grip, by suitable fastening means such as adjustable straps 66 which adjustably join the wrist release trainer 10 to the golf club shaft 64 in a plurality of positions. Alternative attaching means, such as disclosed in the my patent, U.S. Pat. No. 4,967,596, may be provided for connecting the container 57 to the shaft 64. With the unit 11 of the wrist release trainer 10 properly mounted upon the golf club shaft 64, the golfer is ready to use the wrist release trainer 10 to monitor his wrist action, and learn proper wrist movement.

As shown in FIG. 1, the golfer has attached unit 11 of the wrist release trainer 10 to the shaft 64 of his golf club. The golfer then places the wristband 44 upon his wrist. The line 42 from unit 11 is extended from the projection 38, through the bore 18, and out of the housing 16 through the open end 20. The line 42 is fastened to the wristband 44.

Figure 3:
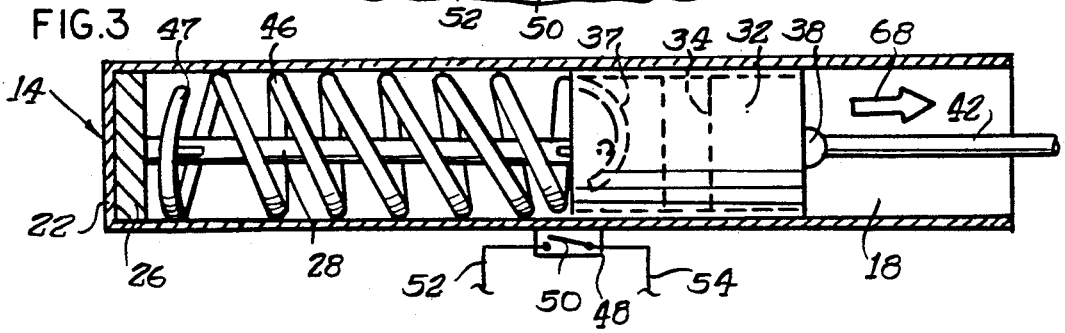
FIG. 3 is a sectional view of the transducer employed in the wrist release trainer with the container not being shown for clarity, showing the particular disposition of the elements of the transducer, when the golfer has uncocked his wrists, thus opening the electronic circuit, and deactivating the signaling means.

The disposition of the unit 11 and/or the wristband 44 is adjusted so that the line 42 exerts a pulling force 68 upon the magnet assembly 32, overcoming a restoring spring force 70 exerted by the spring 46, so that the magnet assembly 32 translates forward into the position shown in FIG. 3. This translation causes the magnet 34 to move away from the reed relay 48 a distance sufficient to reduce the magnetic force exerted upon the reed relay 48 so that the switch 50 can remain in the open position. The pulling force 68, in the form of tension present in the line 42, maintains the magnet assembly 32 in the extended position depicted in FIG. 3. Now, the golfer actuates the reset switch 62, thereby arming the wrist release trainer 10 for the next golf swing.

The golfer then begins his backswing. As the golfer cocks his wrists during the backswing, the distance between the wrist release trainer 10, and the wristband 44 is shortened, thus decreasing the tension present in the line 42. When the golfer's wrists are completely cocked, the tension in the line 42 has been reduced sufficiently so that the restoring spring force 70 now controls the translation of the magnet assembly 32.

The restoring spring force 70 draws the magnet assembly towards the closed end 22 of the housing 16, bringing the magnet 34 into a position adjacent to the reed relay 48, as shown in FIG. 2. In this position, the magnetic forces generated by the magnet 34 cause the switch 50 within the reed relay 48 to close, thus completing the electronic circuit 12. This allows current to flow through the electronic circuit 12 to the signaling means 13, actuating that means 13, and causing the signaling means 13 to issue a feedback signal to the golfer. The signaling means 13 continues to produce a feedback signal until the golfer's wrists are released from the cocked position, increasing the distance between the wrist release trainer 10 and the wristband 44, so that the magnet 34 is pulled, once again, away from the reed relay 48, allowing the switch 50 to open.

In this manner, a golfer can use the wrist release trainer 10 to monitor his wrist movement, improve his golf swing, and decrease his golf score. The signaling means 13 provides feedback signals of different time durations depending on the correctness of his wrist movement. A golfer who does not cock his wrists will receive no feedback signal, whereas a golfer who cocks his wrists too early during his swing will receive an early feedback signal. Only a golfer who employs the proper wrist movements during his golf swing will receive a long feedback signal. By comparing the duration of the feedback signals, and trying to emulate a swing that produced a long feedback signal, the golfer will learn how to improve his swing by employing proper wrist movements. Proper and continuous use of the wrist release can add to the golfer's enjoyment of the game of golf because he will have mastered an improved golf swing, which usually leads to lower golf scores.

Figure 5:
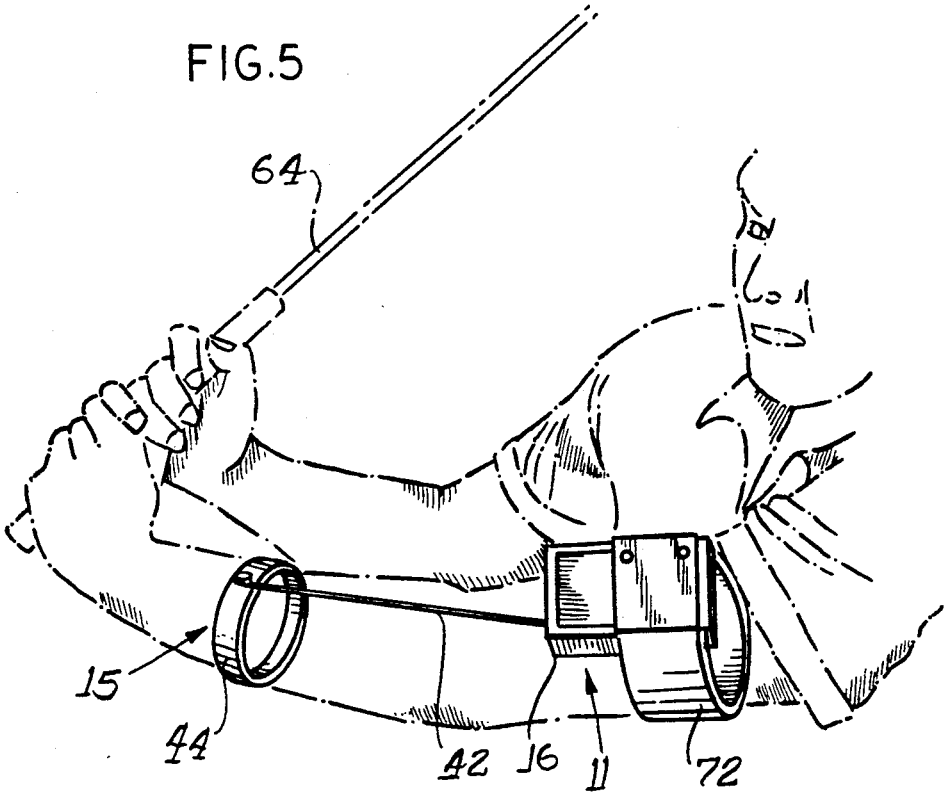
FIG. 5 is a partial elevational view of a golfer, with his arms extended during a golf swing, using a modification of the wrist release trainer to monitor his arm extension, and to learn a more appropriate arm extension.

The same general construction, as described above, of the wrist release trainer 10 can be used to monitor and learn proper arm extension during a golf swing, as shown in FIG. 5. To execute a golf swing properly, it is necessary for a golfer to keep his arm (i.e. left arm for a right-handed golfer) fully extended, with his elbow straight. To monitor arm extension, minor changes are made to the wrist release trainer 10. Specifically, the fastening means 66 on the unit 11 are replaced by an adjustable arm band 72. The arm band 72 is constructed so as to accept a human arm, thereby allowing the unit 11 to be attached to an arm of a golfer above his elbow. The line 42 now extends downwards, across the golfer's elbow, to the wristband 44, which is attached in proximity to the golfer's wrist of the same arm.

The disposition of the arm band 72 and/or the wristband 44 are adjusted on the golfer's arm in a fashion similar to that disclosed above, as is the operation of the wrist release trainer 10. When the golfer's arm bearing the wrist release trainer 10 is straight, with the elbow being straight, during a proper backswing, the distance between the wrist release trainer 10 and the wristband 44 is maximized, as shown in FIG. 5, so that the line 42 pulls the magnet 34 away from the reed relay 48. In this disposition, the switch 50 is open, and the signaling means 13 is not activated.

Figure 6:
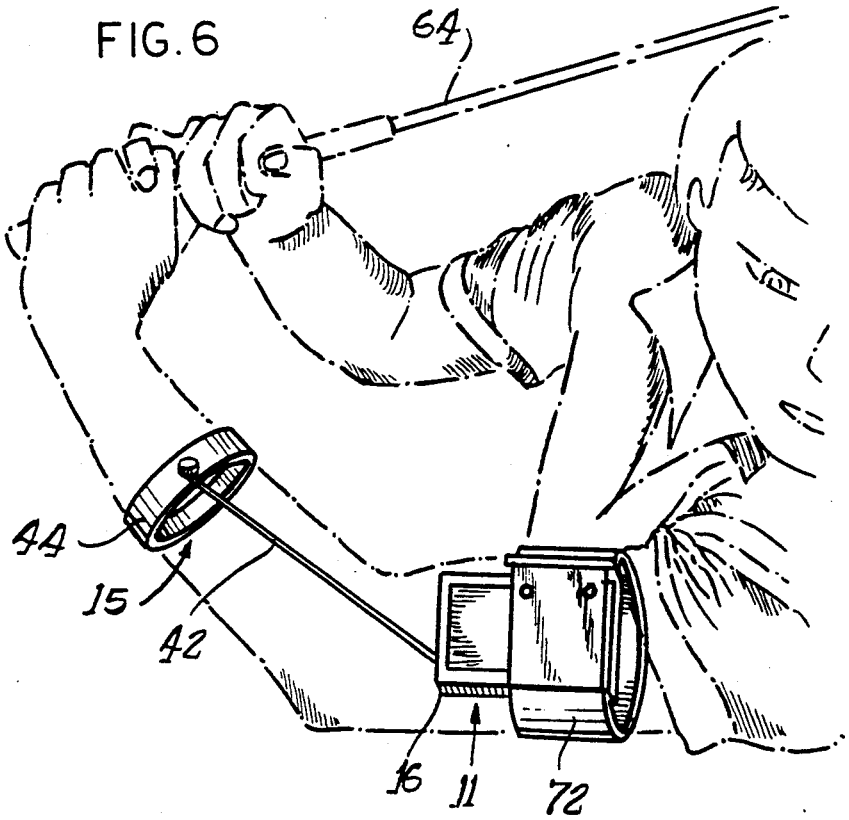
FIG. 6 is a view similar to that of FIG. 5 showing the disposition of the trainer when the golfer has bent his elbow during a golf swing thereby activating the signaling means.

When the golfer improperly executes his backswing, his arm is collapsed, with the elbow being bent, as shown in FIG. 6, and, under the influence of forces described above, the magnet 44 moves into a position adjacent to the reed relay 48, closing the switch 50 and energizing the signaling means 13. The signaling means 13 issues a feedback signal to the golfer, and continues to produce that signal until the golfer's arm is straightened. In this manner, the golfer can use the wrist release trainer 10 to monitor his arm extension during his golf swing, and to learn a more appropriate arm extension. By learning proper arm extension, the golfer can reduce his golf score, and increase his enjoyment of the game.

Figure 7:
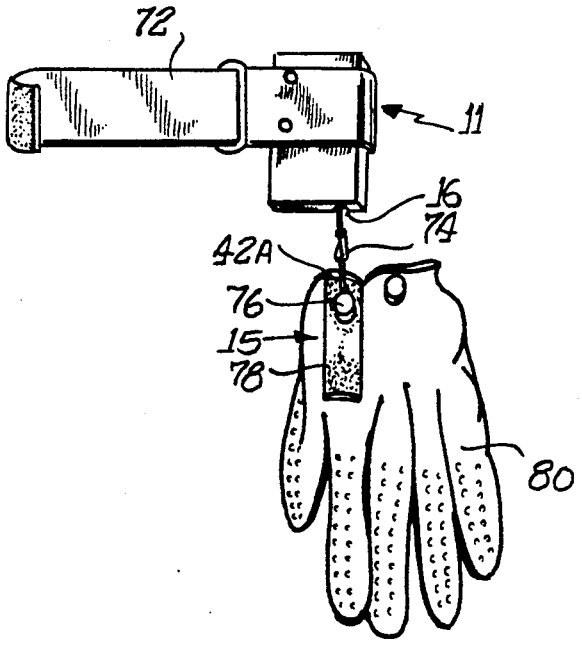
FIG. 7 is an elevational view of another modification of the trainer, with the connecting means being attached to a strip located on a golf glove, for use by a golfer to learn not to "cup" his wrists during a golf swing or putting stroke.

In another embodiment, shown clearly in FIG. 7, the wrist release trainer 10 can be used by the golfer to learn not to cup his wrists during a golf swing, such as a putting or chipping stroke. This is necessary in order to have maximum directivity control of the golf ball. To do this, minor changes are made to the wrist release trainer 10 as described in the last mentioned embodiment. Specifically, the line 42 is connected to the projection 38 by means of a quick connect 74 of known construction. The quick connect 74 allows for the easy removal of the line 42. The line 42 is of sufficient length in order for the wrist release trainer 10 to function properly in the above-mentioned embodiments. However, as will become clear herein, the line 42 is too long to allow the wrist release trainer 10 to function properly in monitoring wrist cupping.

In order for the wrist release trainer 10 to be used to monitor wrist cupping, the line 42 is disconnected from the projection 38 by means of the quick connect 74, and a relatively shorter line 42A is connected to the projection 38 by means of the same quick connect 74. An end of the line 42A opposite to the quick connect 74 terminates at a button 76. The button 76, on a side thereof opposite to the line 42A, has a fastener element, such as a snap or hooked fabric of the type sold under the trademark VELCRO disposed thereon. In this manner, the button 76, and, therefore, one end of the line 42A can be attached to a complimentary fastener element, such as a complementary snap or strip 78 of VELCRO TM material disposed on an exterior surface of a golf glove 80.

With these changes to the wrist release trainer 10, the wrist release 10 is ready to monitor wrist cupping. The adjustable arm band 72 is adjusted so as to hold the unit 11 firmly about a golfer's forearm, in a disposition just above the wrist joint of the same arm. The button 76 is attached to the VELCRO TM strip disposed on the golf glove 80 by means of the well-known VELCRO TM mechanism. In this manner, the line 42A travels from the unit 11 downwards, across the wrist of the golfer, and terminates at the button 76 on the golf glove 80. Then, the disposition of the arm band 72 and/or the button 76 are adjusted in a fashion similar to that disclosed above, as is the operation of the wrist release trainer 10.

Figure 8:
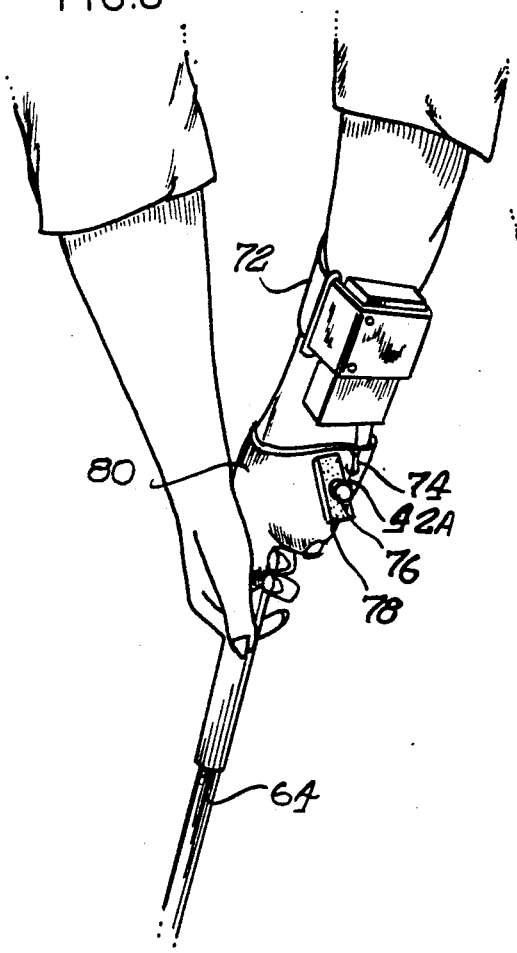
FIG. 8 is a partial elevational view of a golfer, with his wrists in proper disposition, using the modification of FIG. 7 to monitor wrist cupping.

When the the golfer's hands and wrists are in a proper position (i.e. straight and not cupped), as shown in FIG. 8, the distance between the unit 11 and the button 76 is maximized, so that the line 42A pulls the magnet 34 away from the reed relay 48. In this disposition, the switch 50 is open, and the signaling means 13 is not activated.

Figure 9:
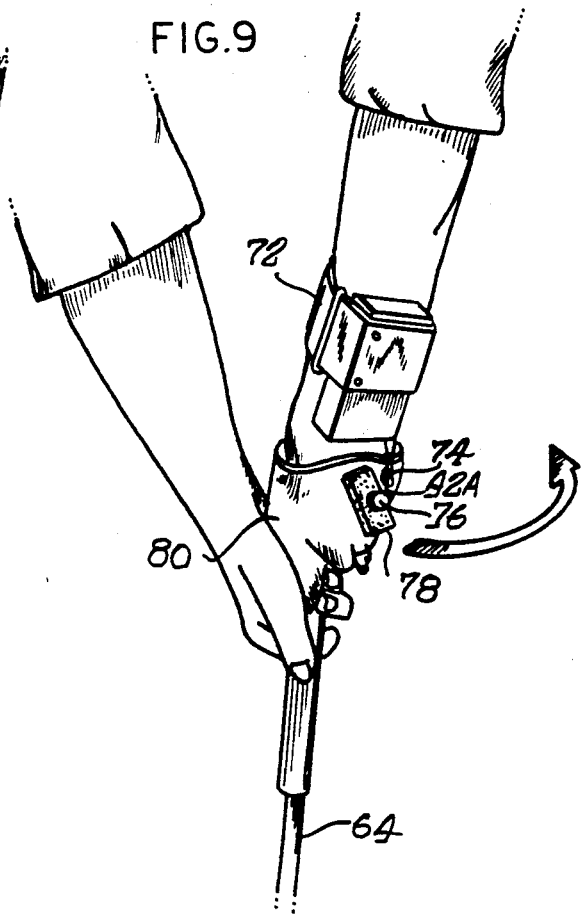
FIG. 9 is a view similar to that of FIG. 8 showing the disposition of the wrist release trainer and the golfer's wrists when the golfer has "cupped" his wrists during a golf swing or putting stroke, thereby activating the signaling means.

When the golfer swings his golf club improperly, by cupping his wrists as shown in FIG. 9, the distance between the wrist release trainer 10 and the button 76 is reduced, thereby allowing the magnet 34 to move, under the influence of the above-described forces, into a position adjacent to the reed relay 48, thereby closing the switch 50, and energizing the signaling means 13. The signaling means 13 issues a feedback signal to the golfer, and continues to issue that signal until the golfer's wrists are un-cupped. In this manner, the golfer can use the wrist release trainer 10 to learn not to cup his wrists during a golf swing, thereby improving and increasing his enjoyment of the game.

While preferred embodiments of the present invention have been shown and described, it is envisioned that those skilled in the art may devise various modifications of the present invention without departing from the spirit and scope of the appended claims. For instance, the invention may be mounted on a leg of the golfer, with the connecting means transversing a knee, to monitor leg movements during a golf swing. The invention is not intended to be limited by the foregoing disclosure, but only by the following appended claims.

The invention claimed is:

1. A device useful to a golfer in monitoring and learning proper bodily movement during a golf swing comprising; an electronic circuit having a transducer, and signaling means; the signaling means being capable of producing a feedback signal; the transducer comprising a housing; a movable element shiftably disposed within the housing; means for translating the movable element within the housing; means for monitoring the movement of the golfer's body which control the means for translating the movable element so that the movable element translates within the housing according to the movement of the golfer's body; and the movable element being capable of actuating the electronic circuit so that the signaling means can produce a feedback signal; said movable element having a magnetic portion and a relay switch disposed about the housing so that the magnetic portion of the movable element is capable of actuating the relay switch magnetically, thereby activating the electronic circuit to cause the signaling means to produce a feedback signal.

2. A device comprising the elements of claim 1 wherein the signaling means comprises an audio speaker.

3. A device comprising the elements of claim 1 wherein the means for translating the movable element within the housing comprise a spring and a line.

4. A device comprising the elements of claim 1 having attaching means for mounting the device on a golf club.

5. A device comprising the elements of claim 4 wherein the attaching means comprise an adjustable strap.

6. A device comprising the elements of claim 1 wherein the means for monitoring the movement of the golfer's body comprises a wristband, and a line connected to the wristband at one end, and to the movable element at the other, so that movement of the wristband dictates the translation of the movable element within the housing.

7. A device for monitoring and improving bodily movement during a golf swing comprising: a mountable transducer; a member responsive to bodily movements during a golf swing; the member being connected with the transducer for actuating the transducer in response to bodily movements during a golf swing; the transducer comprising a magnetically operable switch, and a magnet; the switch and the magnet being relatively movable by the member; and signaling means responsive to actuation of the transducer for providing the golfer with feedback representative of the bodily movements during a golf swing.

8. A device for monitoring and improving bodily movement during a golf swing comprising: a transducer mountable on one of a golf club and an arm of a golfer; connecting means mountable on one of a wrist and a hand of a golfer, and connected with the transducer for actuating the transducer in response to bodily movements during a golf swing; the transducer comprising a magnetically operable switch, and a magnet; the switch and the magnet being relatively movable by the connecting means; and signaling means responsive to actuation of the transducer for providing the golfer with feedback representative of the bodily movements.

9. A device for monitoring bodily movement of a golfer during a golf swing comprising: first attaching means mountable on one of a golf club, a hand, and a limb of the golfer at one side of a joint in the golfer's limb; second attaching means mountable on the limb of a golfer at an opposite side of the joint; a transducer supported by one of the attaching means; connecting means for traversing the joint connected with the other of the attaching means and with the transducer for actuating the transducer in response to flexing of the joint during a golf swing; the transducer comprising a magnetically operable switch, and a magnet; the switch and the magnet being relatively movable by the connecting means; and signaling means responsive to actuation of the transducer for providing the golfer with feedback representative of the movement.

10. A device as defined in claim 9 wherein the transducer includes a spring for returning the magnet to a rest position upon relaxing the connecting means.

11. A device as defined in claim 9 wherein the joint is a wrist of the golfer, the first attaching means is mountable on a golf club, and the second attaching means is mountable on a forearm of the golfer.

12. A device as defined in claim 9 wherein the joint is an elbow of the golfer, the first attaching means is mountable on a forearm of the golfer, the second attaching means is mountable on an upper arm of the golfer, and the connecting means traverses the elbow.

13. A device as defined in claim 9 wherein the joint is a wrist of the golfer, the first attaching means is mountable on a hand of the golfer, and the second attaching means is mountable on a forearm of the golfer.

* * * * *